United States Patent [19]

Maynard

[11] 3,963,130

[45] June 15, 1976

[54] COIL UNLOADER

[75] Inventor: James J. Maynard, Marcellus, N.Y.

[73] Assignee: Syracuse Supply Co., Inc., Syracuse, N.Y.

[22] Filed: May 15, 1974

[21] Appl. No.: 470,057

[52] U.S. Cl. ..... 214/130 C; 214/95 R; 214/730; 214/750; 214/DIG. 3; 214/DIG. 4; 294/86 LS; 294/103 CG

[51] Int. Cl.[2] ..... B66C 23/00

[58] Field of Search ..... 214/1 P, 130 C, DIG. 1, 214/DIG. 3, DIG. 4, 620, 730, 731, 750, 95 R; 294/67 A, 67 AA, 86 LS, 103 CG

[56] References Cited

UNITED STATES PATENTS

| | | | |
|---|---|---|---|
| 2,887,092 | 5/1959 | Brady | 214/620 |
| 3,075,664 | 1/1963 | Collings | 294/86 LS |
| 3,572,530 | 3/1971 | Ohntrup et al. | 214/730 |
| 3,682,334 | 8/1972 | Breitfuss | 214/730 |
| 3,786,948 | 1/1974 | Golden | 214/130 C |

FOREIGN PATENTS OR APPLICATIONS

| | | | |
|---|---|---|---|
| 918,601 | 2/1963 | United Kingdom | 294/86 LS |
| 260,508 | 4/1970 | U.S.S.R. | 214/750 |

*Primary Examiner*—Robert J. Spar
*Assistant Examiner*—Ross Weaver
*Attorney, Agent, or Firm*—Bruns & Jenney

[57] ABSTRACT

A highly flexible unloading device, adapted for use with a truck having a lift mechanism, lifts coils of wire from hard to approach positions. A stationary boom extends from the truck's lift mechanism to a junction member. The junction member, operably connected to the stationary boom, can be rotated in a vertical plane by a first motor means. A rotatable boom operably connected to the junction member can be rotated in a horizontal plane by a second motor means. Being operably connected to the vertically rotatable junction member, the rotatable boom also rotates in the vertical plane. The rotatable boom has a ram member extendable therefrom by a third motor means.

3 Claims, 9 Drawing Figures

COIL UNLOADER

BACKGROUND OF THE INVENTION

This invention relates to an unloading device for use with a truck, and more particularly to a highly flexible attachment for use with a truck having a lift mechanism, the attachment being particularly adapted for unloading coils from hard to approach positions.

Many devices exist for handling coils of wire that are in easily accessible positions; a device representative of the art is seen in U.S. Pat. No. 1,626,555 issued to E. H. Remde. Wire coils, however, are not always in accessible positions. For example, during shipment the coils are in gondola railroad cars where, besides being loaded with their axial openings perpendicular to the direction of the line of travel of an unloading truck, these coils have their axial openings blocked from direct access by the end walls of the railroad cars.

Presently, to unload these coils some form of mobile crane is used, the usual type having a rotating main boom with a built-in extendible boom. This type of crane is designed primarily to work from a stationary position with outriggers extended to the ground for stability. When transporting materials these cranes usually have poor maneuverability, speed and stability characteristics, and suffer the further disadvantage of being single purpose machines that must be parked when the unloading job is finished.

SUMMARY OF THE INVENTION

A highly flexible unloading device, intended for use with a truck having a lift mechanism, is able to lift coils of wire from hard to approach positions. The preferred embodiment of the invention is an attachment for a rubber tired wheel unloader, this attachment being particularly adapted to unload coils from gondola railroad cars. A stationary boom extends from the truck's lift mechanism to a junction member. The junction member, operably connected to the stationary boom can be rotated in a vertical plane by a first motor means. A rotatable boom operably connected to the junction member can be rotated in a horizontal plane by a second motor means. Being operably connected to the rotating junction member, the rotatable boom also rotates in the vertical plane. The rotatable boom has a ram member extendible therefrom by a third motor means. The power and controls for the device are supplied by hydraulic hoses extending from the truck's power source through the controls in the cab of the truck to the three motor means referred to above.

With its unique design, the unloader of this invention picks up, carries and unloads coils of wire while keeping the coils within the width of the truck's tires, and keeping the center of gravity of the coils practically constant relative to the truck's center of gravity. These two features contribute to the stability of the truck during all operations.

The construction of the unloader as an attachment permits its quick replacement by the numerous other attachments presently used with rubber tired wheel unloaders. Also, being attached to a rubber tired wheel unloader, this device has the speed and maneuverability associated with such a truck.

DESCRIPTION OF THE PREFERRED EMBODIMENTS

Figure 2:
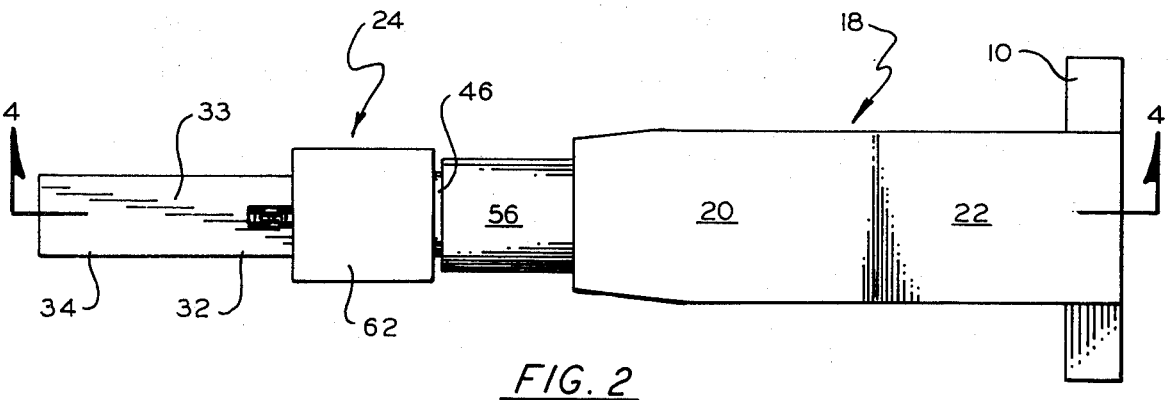
FIG. 2 is a top plan view of the coil unloading attachment.
Figure 1:
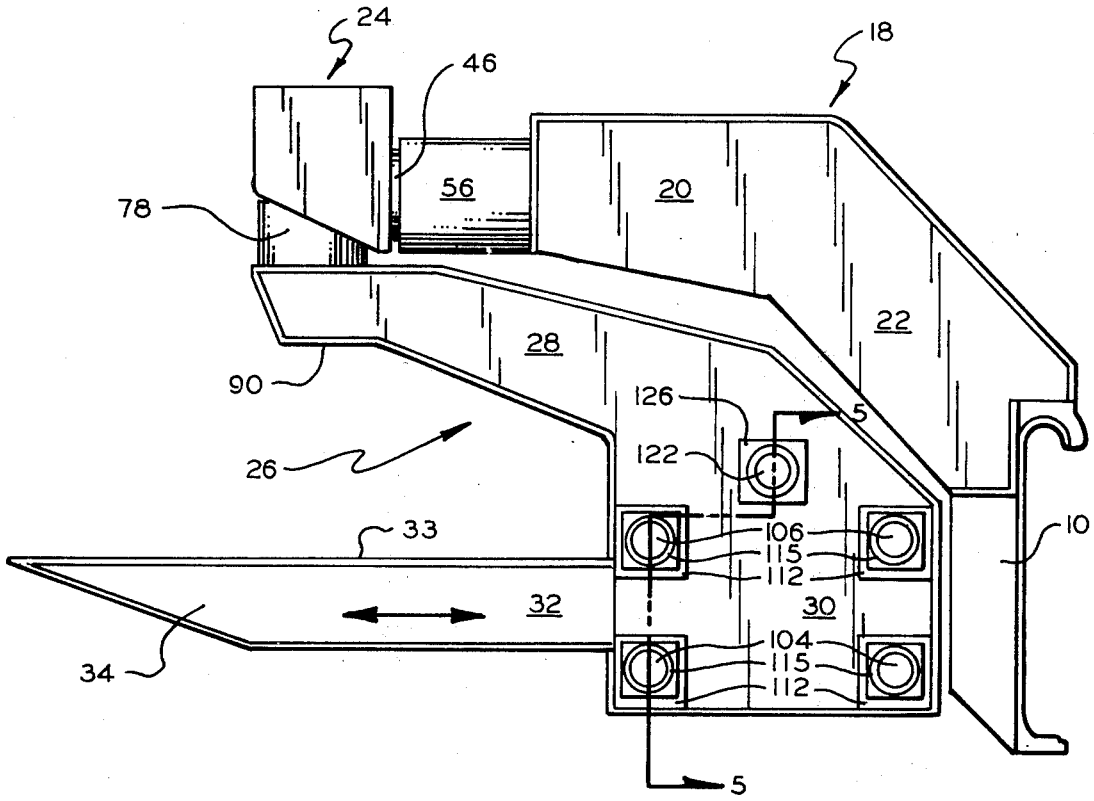
FIG. 1 is a side elevation of a coil unloading attachment embodying this invention.
Figure 3:
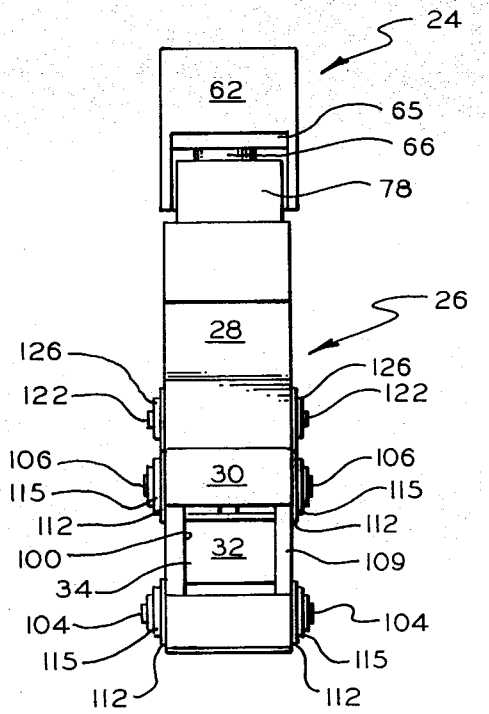
FIG. 3 is a left end elevation of the coil unloading attachment.
Figure 4:
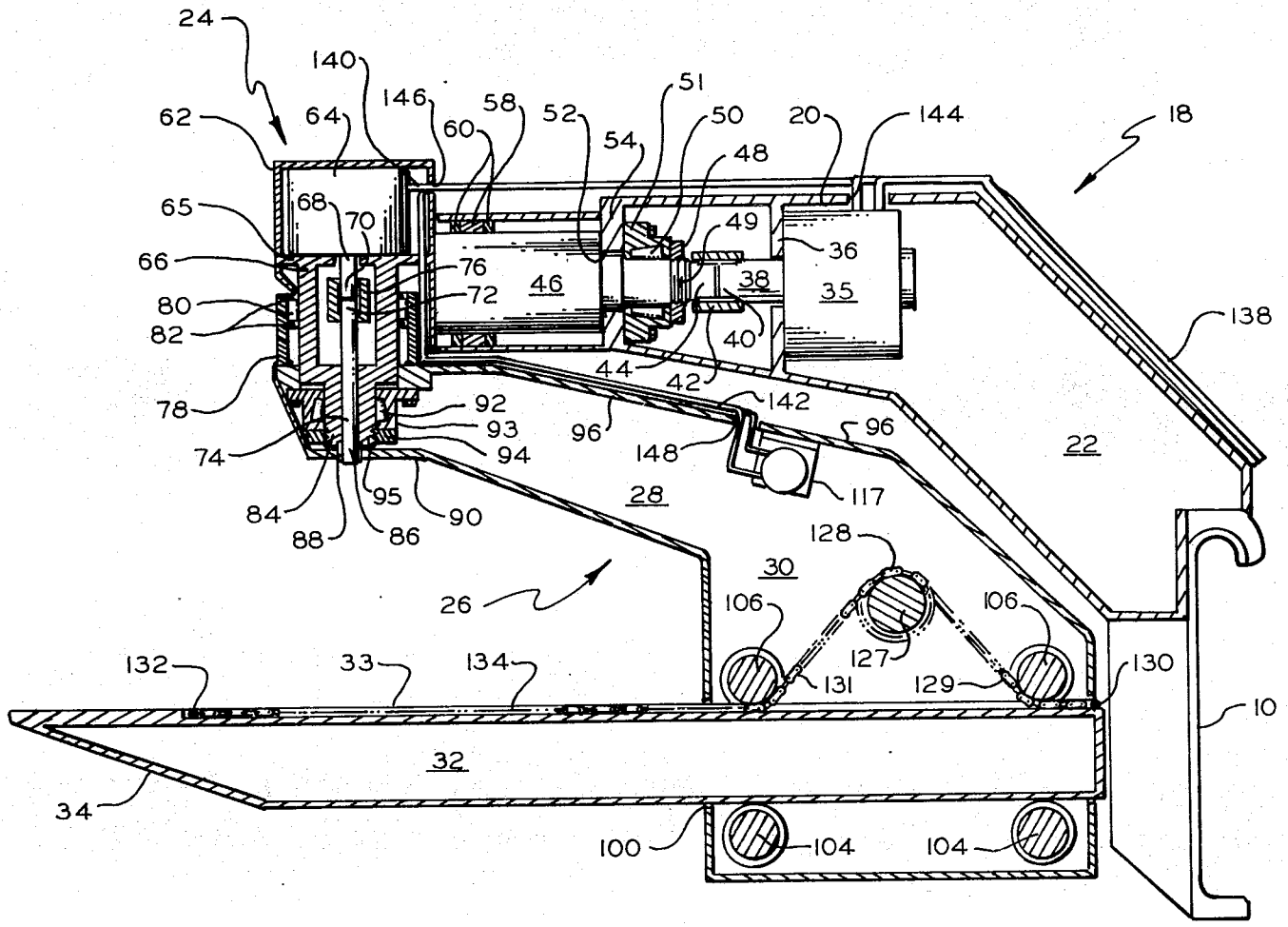
FIG. 4 is a longitudinal section through the coil unloading attachment on line 4—4 of FIG. 2.

Referring now to the drawings, a quick hitch 10 disclosed in U.S. Pat. No. 3,760,883 issued to Billy D. Birk provides the means to secure the unloading device of the invention to a rubber tired wheel loader 12 having standard lift and tilt assemblies 14, 16 as shown in FIGS. 6–9. As seen in FIGS. 1 and 4, a stationary boom 18 generally having a horizontal section 20 and a gusset section 22 is connected to the quick hitch 10. Operably connected to the stationary boom 18 is a junction member 24. A rotatable boom 26 is operably connected to the junction member 24. The rotatable boom 26 has an oblique section 28 and a vertical section 30. A retractable and extendible ram member 32, having a lifting surface 33 and a wedged shape front end 34, is received in the vertical section 30.

While the geometric shape described above is not critical to the concept of this invention it is the optimum shape for the application of this concept to a coil unloader. The vertical section 20 of the stationary boom 18 enables the ram 32 to unload from the opposite side of the railroad car from which the truck 12 is standing. The gusset section 22 affords more strength than could be had from a right angle connection between a purely horizontal boom and a vertical coupling means. The rotatable boom 26 has an essentially horizontal section 28 whereby the load is carried within the width of the truck's wheels, thereby providing greater operating stability. The vertical member 30 of boom 26 provides the support for the rectractable boom 32.

To one skilled in the art it will be obvious that booms of other shapes will be more appropriate for other applications of the invention.

In cross section (FIG. 4) it may be seen that a hydraulic motor 35 is held in place within the horizontal section 20 of the stationary boom 18 by a mounting plate 36. The shaft 38 of motor 35 has its splined end 40 connected through an internally splined coupler 42 to the splined end 44 of a driven shaft 46. Both shaft ends 40, 44 need not be splined but it is advisable to have at least one end splined to permit some axial movement between the shafts as a load is applied to the apparatus (as will be described).

A nut 48 is screwed on a threaded portion 49 of the driven shaft 46 as it extends from the coupler 42. After passing through nut 48 the shaft passes through a tapered roller bearing 50 having a housing 51. From there the driven shaft 46 passes through aperture 52 in the end wall 54 of the stationary boom 18 and into a protective sleeve 56 welded to the end wall 54. The housing 51 of the roller bearing is bolted to the inside of end wall 54. Nut 48, acting against roller bearing housing 51 and thus end wall 54, resists the axial pull on the driven shaft 46 resulting from the weight of the junction member 24, the rotatable boom 26 and the load.

The driven shaft 46 rotates within the protective sleeve 56 on bronze bushing 58 held between grease seals 60. Shaft 46 after passing through the protective sleeve 56 is welded to the junction member 24 whereby all rotational movement of the shaft is transmitted to the junction member.

The junction member 24 includes a motor housing 62 and a second hydraulic motor 64 retained in the housing by a mounting plate 65. Projecting downwardly from the mounting plate 65 and welded thereto is an inner sleeve 66. The shaft 68 of motor 64 extends into the inner sleeve 66 where its splined end 70 is connected to the splined end 72 of a driven shaft 74 by an internally splined coupler 76. Both shaft ends 70 and 72 need not be splined but it is advisable to have at least one end splined to permit some axial movement of the shafts as a load is applied to the apparatus.

The concentric members, driven shaft 74 and inner sleeve 66, pass through an outer sleeve 78 welded to the section 28 of the rotatable boom 26. The inner sleeve 66 rotates within the outer sleeve 78 on bronze bushing 80 held between grease fittings 82. After passing through the outer sleeve 78, the shaft 74 and sleeve 66 enter the section 28 of the rotatable boom 26. As the inner sleeve 66 enters the boom its diameter is reduced creating a reduced diameter portion 84 having a close sliding fit with driven shaft 74. After passing through the reduced diameter portion 84 of the sleeve 66, the splined lower end 86 of shaft 74 extends into a mating splined hole 88 in the bottom wall 90 of the section 28, whereby rotational movement of the shaft is transferred to the rotating boom 26.

Encircling the inner sleeve 66 within the rotatable boom 26 is a tapered roller bearing 92 having a housing 93. A nut 94 is screwed on a threaded portion 95 of the sleeve 66 below the bearing housing which in turn is bolted to the underside of a top plate 96 of the rotatable boom 26 as shown.

The use of a dead shaft (driven shaft 74) allows a stronger member — here inner sleeve 66 through nut 94 and bearing housing 93 — to support the full weight to the rotatable boom 26 and the load. The presence of a dead shaft further permits the motor 64, the driving shaft 68 and the driven shaft 74 to be removed for maintenance without dismantling the junction member 24 and rotatable boom 26.

Figure 5:
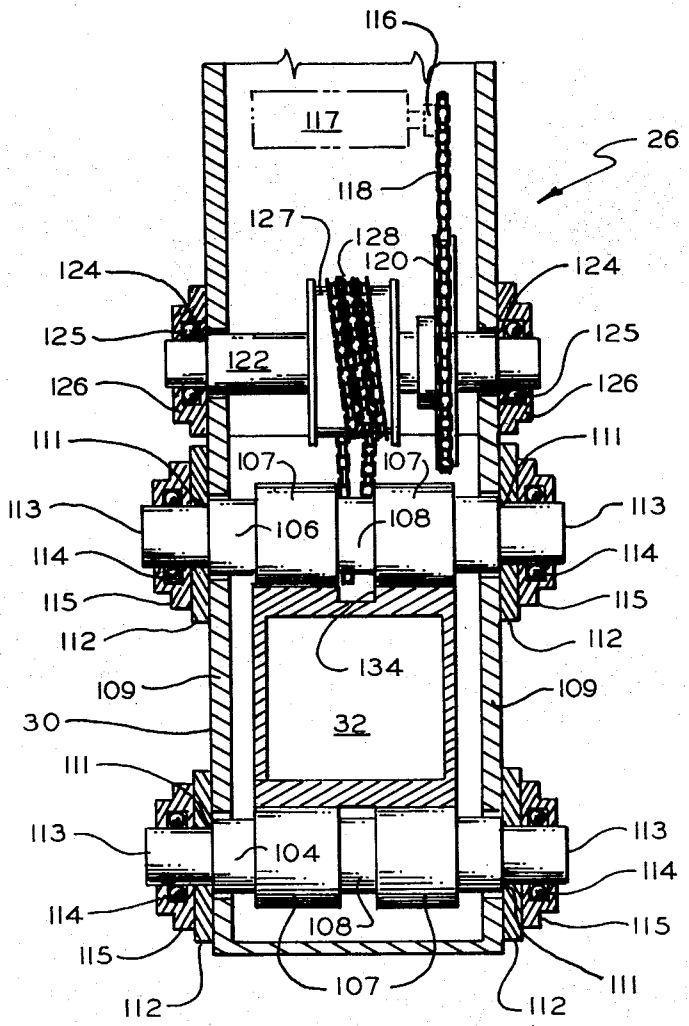
FIG. 5 is a transverse section through the coil unloader attachment on line 5—5 of FIG. 1.

The vertical section 30 of the rotatable boom 26 has a passageway 100 extending longitudinally therethrough as best seen in FIG. 4. The retractable and extendible ram 32 is received in this passageway 100 and is supported between four rollers, two rollers 104 below the ram and two rollers 106 above. As seen in FIG. 5, rollers 104, 106 each have increased diameter portions 107 which contact the ram 32. Grooves 108 formed at the center of the increased diameter portions 107 are only functional in the top roller 106, the grooves in the lower roller 104 permitting an interchange of the top and bottom rollers is required.

As seen in FIG. 5 the top and bottom rollers 106, 104 extend transversely through vertical section 30. After passing through side walls 109 of the section, the diameter of the rollers 104, 106 decreases creating shoulders 111. Side plates 112 secured to the walls 109 hold the shoulders 111 and thus the rollers from axial movement. Decreased diameter portions 113 of the rollers rotate in bearings 114 having housings 115 that are connected to the side plates 112.

A sprocket 116 powered by a third hydraulic motor 117, secured to the underside of top plate 96 of the rotatable boom 26, has a continuous chain 118 running from the sprocket 116 to a sprocket 120 fixed on an axle 122. Axle 122 extends through side walls 109 after which its diameter decreases forming shoulders 124. Bearings 125 in housings 126 rotatably support axle 122. Housings 126 hold shoulders 124 and thus axle 122 from axial movement. As chain 118 is turned by sprocket 116, a drum 127, also fixed on axle 122, rotates.

A flexible connecting means 128, such as a cable or a chain as shown in FIG. 4, is wrapped around drum 127 and has its rear portion 129 fastened to a rear catch 130 (to the right in FIG. 4) on the ram 32 and its front portion 131 fastened to front catch 132 (to the left in FIG. 4) on the ram. A recess 134 in the top of the ram 32 and running from front catch 132 to rear catch 130 is dimensioned to receive chain 128 with a clearance fit. Recess 108 in the top rollers 106 channels the chain 128 into recess 134 and holds it in the recess for that portion of the ram not in cavity 100. Held in recess 134, the chain 128 is prevented from extending above the exposed lifting surface 33 of the ram 32.

Although this unloading apparatus employs a drum 127 turned by a chain 118 which is in turn turned by a sprocket 116, it is obvious that the hydraulic motor 117 can be positioned to rotate drum 127 directly.

Power and control are supplied to the three hydraulic motors 35, 64 and 117 of the unloader by three pairs of hydraulic hoses (not shown) extending from the truck's power supply through the truck's control panel to the quick hitch 10. At the quick hitch, the hoses are connected to three corresponding pairs of hoses 138, 140 and 142 of the unloading device (FIG. 4).

Hoses 138 extend from the quick hitch 10 to holes 144 in the stationary boom 18 and pass through these holes to connect to first hydraulic motor 35. Hoses 140 run parallel to the hoses 138 along the stationary boom but continue past holes 144 to enter holes 146 in the junction member where they connect to hydraulic motor 64. Hoses 142 run parallel to hoses 140 but after passing through holes 146 run along the inside of junction member 24 to the rotatable boom. After extending along horizontal section 28, the hoses pass through holes 148 to connect to hydraulic motor 117.

As is well known, other means can provide the same power and control provided by the three hydraulic motors of the preferred embodiment of this invention.

While shown in the drawings of the preferred embodiment as an attachment for a rubber tired wheel unloader, the novel unloading device of this invention works equally well as a permanent fixture on any truck means. Also, while shown with an extendible ram, the device can be fitted with other operable means such as a scoop or a grapple.

In the description of its normal operation, the lifting mechanism of the invention will be shown connected to a rubber tired wheel unloader 12 in FIGS. 6 through FIG. 9. The initial position, assumed to be as in FIG. 6, has the ram 32 fully extended and the rotatable boom 26 positioned directly beneath the stationary boom 18. In this position the ram 32 extends parallel to the line of travel of the truck 12, enabling the device to pick up, carry and stack coils of wire as is normally done with a rigid ram.

All coils of wire, however, are not positioned so that their axial openings are accessible to a rigid ram. For example, coils 152 of FIG. 8 shipped in gondola railroad cars 154 not only have their open faces perpendicular to the direction of motion of the truck but also have their open faces blocked from direct access by the end wall 156 of the gondola car. The flexibility of the coil unloader of this invention will be illustrated by the following description of how the device is operated to unload coils from fully loaded gondola cars.

Figure 6:
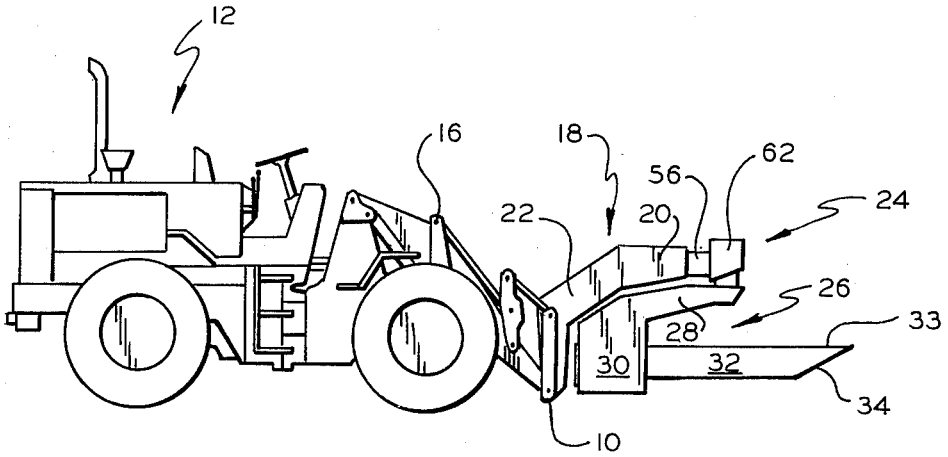
FIG. 6 is a side elevation of the coil unloading attachment coupled with a rubber tired wheel loader.
Figure 7:
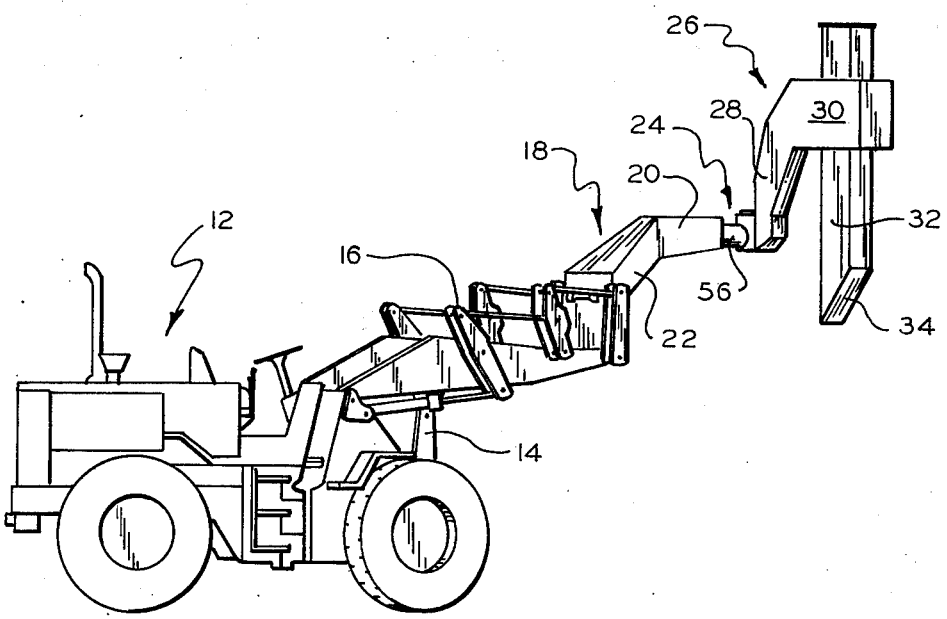
FIGS. 7, 8 and 9 are perspective views of the coil unloading attachment coupled with a rubber tired wheel loader showing successive steps in removing a coil of wire from a railroad car.
Figure 8:
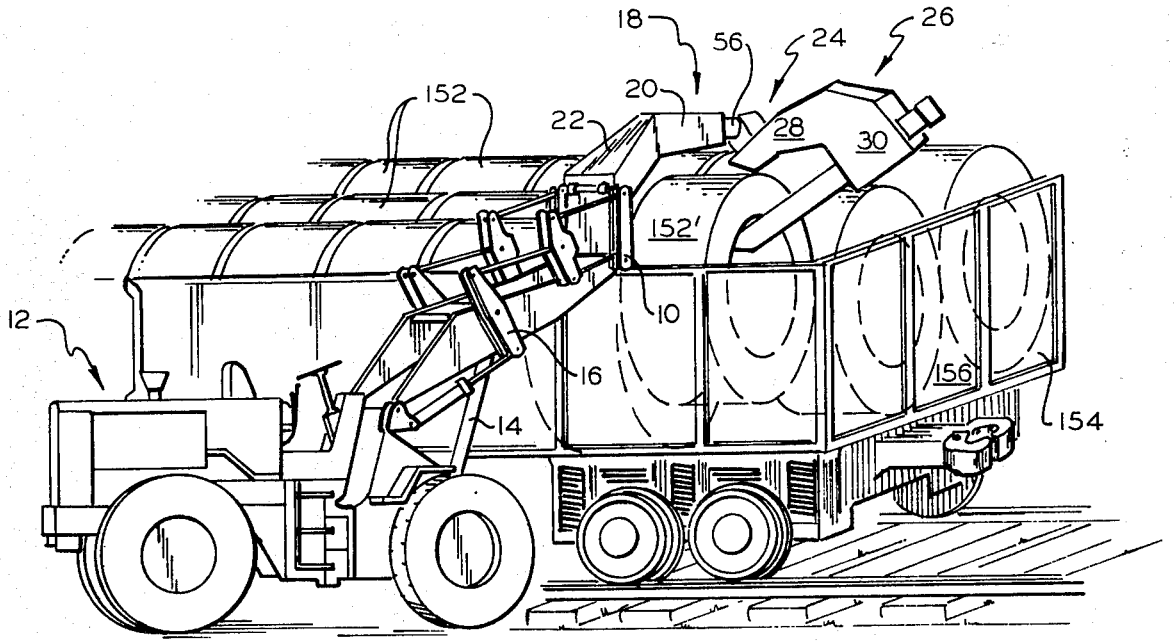

With the unloader initially positioned as in FIG. 6, to unload the first coil 152' of FIG. 8 from a fully loaded gondola car 154, the unloader must first be moved into the position seen in FIG. 7. To achieve this position power is applied to the lifting assembly 14 of the truck 12, whereby the unloader attachment is raised above the side of the gondola car. Power is then applied by the operator through his controls (not shown) and through hydraulic hoses 140 to hydraulic motor 64 whereby the driving shaft 68 is caused to rotate 90° counterclockwise (as seen from above). As the driving shaft turns, it operates through coupler 76 and driven shaft 74 to cause the rotatable boom 26 to turn 90° counterclockwise in the horizontal plane. As the rotatable boom turns inner sleeve 66 fixed to mounting plate 65 remains stationary, while outer sleeve 78 fixed to the boom 26 turns on bushing 80. Also bearing housing 93 secured to the top plate 96 of the boom turns relative to the stationary reduced diameter portion 84 of inner sleeve 66.

Power is next applied by the operator through his controls and through hydraulic hoses 138 to the hydraulic motor 35, whereby the driving shaft 38 is caused to rotate 90° counterclockwise (as seen from the truck). As the driving shaft turns, it operates through coupler 42 and driven shaft 46 to cause the attached junction member 24 and thus the rotatable boom 26 to turn 90° counterclockwise in the vertical plane.

The ram 32 is partially retracted by the operator through his controls which act through hydraulic hoses 142 to actuate hydraulic motor 117. As motor 117 turns sprocket 116 clockwise chain 118 causes drum 127 to turn clockwise (with reference to FIG. 5). As the drum turns the front portion 131 of chain 128 is wound around the drum causing the ram's front, wedged end 34 to be pulled towards the drum. Also as the drum turns the rear portion 129 of chain 128 is unwound from the drum permitting the ram's rear end to move away from the drum 127.

The truck 12 is positioned at one end of the railroad car 154 to be unloaded with its front end perpendicular to the direction of travel of the car. The truck is then moved forward until the junction member 24 is above the axis of the coil 152' to be unloaded as seen in FIG. 8. The tilt assembly 16 of the truck is adjusted until the wedged end 34 of the ram 32 is positioned between the coil and end wall 156 of the gondola car 154.

Alternately, the ram 32 is extended and the rotatable boom 26 is rotated clockwise in the vertical plane (as seen from the truck, FIG. 8). The ram is extended similar to the manner in which it is retracted. For extension, power is supplied to the hydraulic motor 117 so that sprocket 116 turns counterclockwise, FIG. 4, and causes the front portion 131 of the chain 128 to be unwound from the drum 127 and the rear portion 129 of the chain 128 to be wound on the drum. Gravity and the pull of chain 128 on the rear catch 130 will cause the ram 32 to extend.

The rotatable boom 26 is rotated clockwise similar to the manner in which it is rotated counterclockwise. Here power is supplied to hydraulic motor 35 so that it turns driving shaft 38 and driven shaft 46 clockwise. As the driven shaft turns, the junction member 24 and the rotatable boom 26 turn clockwise. See FIG. 8.

In conjunction with extending the ram 32 and rotating the boom 26, the lift and tilt assemblies 14, 16 of the truck 12 are manipulated. This procedure will lift the coil from the railroad car 154. FIG. 8 shows the above described procedure partially completed.

Figure 9:
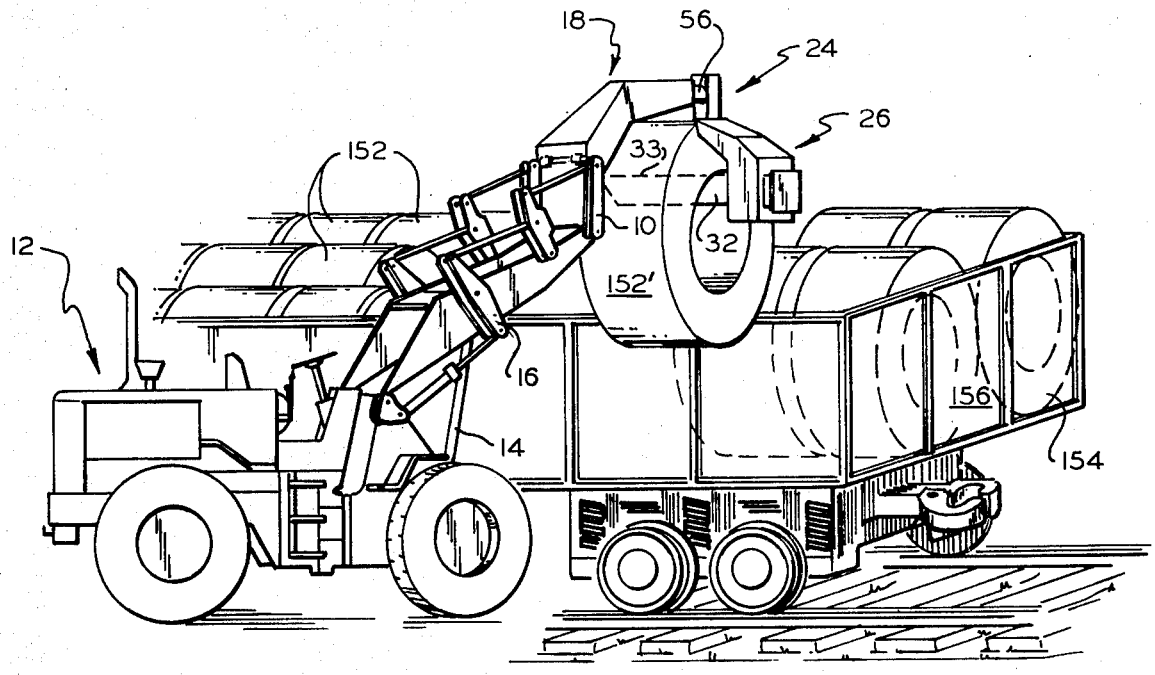

When the above procedure is completed, the coil 152' will be held on the lifting surface 33 of the ram 32, centered approximately beneath the junction member 24, as seen in FIG. 9. With the load carried in this manner its center of gravity will always be within the width of the wheels of the truck and always in the same position relative to the center of gravity of the truck. With the weight so centered this unloader will be more stable than the extendible cranes presently used for unloading.

The rotatable boom 26 can now be turned 90° clockwise (as seen from above) in the horizontal plane, whereby the ram 32 once again extends in the line of travel of the truck 12. In this position the unloader again resembles a rigid ram and can be unloaded in the usual manner by lowering the lift assembly 14 and moving the truck 12 rearward. However, with the flexibility built into the device it is possible to unload the coils of wire with their axial openings perpendicular to the direction of motion of the truck. To do this the rotatable boom is not turned 90° as described above but is left as is once the coil has been lifted from the railroad car 152. To unload a coil carried perpendicular to the direction of travel of the truck, one must take advantage of the ram's ability to be retracted. After the lift assembly 14 has been operated to lower the ram until the coil comes into contact with the ground and the ram's lifting surface 33 has moved out of contact with the coil, the ram is retracted in the manner previously described.

To unload the remainder of the coils from the railroad car the above procedure is repeated. However, as each succeeding coil is removed the vertical angle through which the hydraulic motor 35 turns the junction member 24 is decreased. Eventually the unloader will be able to remove the coils 152 by merely having the ram 32 partially retracted adjacent the axial opening of the coils and pointing perpendicular to the line of travel of the railroad car 154. By extending the ram 32 and manipulating the lift assembly 14 the coil can be removed from the car.

From the foregoing description, it will be apparent that the present invention provides a novel and very versatile truck attachment particularly well adapted for unloading coils for railroad cars. As will be understood by those familiar with the art, the invention may be embodied in other specific forms without departing from the spirit or essential characteristics thereof.

I claim:

1. An unloading apparatus for use with a truck, said apparatus including:

a stationary member having two ends with one of said ends being spaced from the truck;

means connecting the other of said ends to the truck;

a junction member;

a first connecting means operably connecting said spaced end of said stationary member to said junction member;

a first rotating means forming a part of said first connecting means, whereby said junction member can be rotated relative to said stationary member;

a rotatable member;

a second connecting means operably connecting said rotatable member to said junction member and including a sleeve having two ends with one of said ends fixed to the junction member, a threaded portion on the other end of said sleeve, said threaded portion extending into said rotatable member, a nut screwed on said threaded portion, means on said rotatable member engaged by said nut whereby the sleeve is operably connected to said rotatable member; and a second rotating means forming a part of said second connecting means, whereby said rotatable member can be rotated relative to said junction member.

2. An unloading apparatus for use with a truck, said apparatus including:

a stationary boom having two ends with one of said ends being spaced from the truck;

coupling means connecting the other end of said stationary boom to the truck;

a first rotating means operably connected with said stationary boom;

a first connecting means including a first shaft, said first shaft being rotated by said first rotating means and having an end projecting from said spaced end of said stationary boom;

a junction member connected to said projecting shaft end whereby rotational movement of the shaft is transmitted to said junction member;

a second rotating means operably connected with said junction member;

a second connecting means including a second shaft, said second shaft being rotated by said second rotating means and having an end projecting from said junction member;

a rotatable member;

a sleeve having two ends with one of said ends fixed to the junction member;

a threaded portion at the other end of said sleeve, said threaded portion extending into said rotatable member;

a nut screwed on said threaded portion of said sleeve; and means on said rotatable member engaged by said nut whereby said sleeve is operably connected to said rotatable member.

3. The unloading apparatus of claim 2 wherein the rotatable means includes:

a vertical section having a passageway therein;

a ram member received in said passageway;

power and control means including a driving member; and flexible connecting means secured to the ram adjacent at least one end thereof, part of said flexible connecting means being wound on said driving member.

* * * * *